US005392026A

United States Patent [19]

Marik

[11] Patent Number: 5,392,026

[45] Date of Patent: Feb. 21, 1995

[54] DOOR LOCK REINFORCER AND ALARM DEVICE

[76] Inventor: Victor Marik, 15422 Empanada, Houston, Tex. 77083

[21] Appl. No.: 44,165

[22] Filed: Apr. 8, 1993

Related U.S. Application Data

[63] Continuation-in-part of Ser. No. 817,323, Jan. 6, 1992, Pat. No. 5,218,341.

[51] Int. Cl.[6] ..... G08B 13/08

[52] U.S. Cl. ..... 340/546; 200/61.49; 292/339; 340/566

[58] Field of Search ..... 340/546, 566; 292/339, 292/338; 200/61.49

[56] References Cited

U.S. PATENT DOCUMENTS

| | | | |
|---|---|---|---|
| 3,502,831 | 3/1970 | McRoskey | 200/61.49 |
| 4,282,518 | 8/1981 | Bonner | 340/566 |
| 4,358,758 | 11/1982 | Morton | 340/546 |
| 4,427,709 | 2/1984 | White | 340/546 |
| 4,438,428 | 3/1984 | Ober et al. | 340/546 |
| 4,442,427 | 4/1984 | Morton | 340/546 |
| 4,483,558 | 11/1984 | Van Meter | 292/339 |
| 4,563,027 | 1/1986 | Chechovsky et al. | 292/339 |
| 4,607,253 | 8/1986 | Wooten et al. | 340/546 |
| 4,883,297 | 11/1989 | Smith | 292/339 |
| 4,971,374 | 11/1990 | Lovell et al. | 292/339 |
| 5,027,105 | 6/1991 | Dailey et al. | 340/566 |
| 5,218,341 | 6/1993 | Marik | 340/546 |

FOREIGN PATENT DOCUMENTS

| | | | |
|---|---|---|---|
| 3627409 | 2/1988 | Germany | 340/546 |
| 2023321 | 12/1979 | United Kingdom | 340/404.1 |

*Primary Examiner*—Glen Swann

*Attorney, Agent, or Firm*—Harrison & Egbert

[57] ABSTRACT

A door locking device has a shaft portion, a non-skid end portion adjustably connected to a lower end of the shaft portion, a door handle engaging bracket affixed to an end of the shaft portion opposite the end portion, and an alarm device mounted to the shaft portion so as to be responsive to shocks affecting the door handle. The alarm device has an audio output. The shaft portion includes an arcuate shape extending outwardly from the bracket, a straight section extending from the arcuate shape, and an angled section extending vertically downwardly from the straight section. The end portion is threadedly received by the angled section. The bracket has a generally U-shaped configuration with a prong formed interior of the U-shaped configuration. The alarm device includes a housing, an alarm emitter connected to the housing, and a shock-responsive trigger circuit positioned within the housing and electrically connected to the alarm emitter so as to pass a signal in response to shocks above a given threshold value.

18 Claims, 4 Drawing Sheets

DOOR LOCK REINFORCER AND ALARM DEVICE

RELATED APPLICATION

The present application is a continuation-in-part application of U.S. application Ser. No. 07/817,323, filed on Jan. 6, 1992, and entitled "DOOR LOCK REINFORCER AND ALARM DEVICE", issued as U.S. Pat. No. 5,218,341 on Jun. 8, 1993.

TECHNICAL FIELD

The present invention relates to door securing devices. More particularly, the present invention relates to door securing devices of the bracing type. The present invention further relates to door locking devices having alarms attached thereto.

BACKGROUND ART

With the rise in violent crimes in the United States, there is a widespread fear among the people related to their sense of security in the home and perhaps, even more important, when travelling. People staying in hotels and motels often find themselves staying in a room protected only by an inexpensive lock. Many devices have been developed to provide a greater degree of protection by providing some type of portable supplemental locking device. These devices generally fall into three main types: the portable door lock that operates with a key, as a second lock in the door; an alarm device that does not impede the operation of the door, but sounds an alarm when disturbed, and the door brace type that is mounted between the door and the floor, which then acts as a brace.

Prior art security braces for blocking entry through doorways are known. Such devices have not been widely adopted commercially for one of two reasons. The prior art devices which work effectively have been too complex and costly to be practical on the commercial market. Those devices in the prior art which are relatively simple and feasible from a cost standpoint have proven not to operate efficiently with consistency, and therefore have not been acceptable in the marketplace.

A number of patents have issued in the past which deal with door bracing devices. For example, U.S. Pat. No. 4,300,796, issued on Nov. 17, 1981, to J. L. Lane provides an adjustable door and window security prop. In this device, adjustable large and small diameter tubular members are telescopically engaged with each other. A U-shaped member is attached to one of these legs so as to engage a door handle. A stop is provided at the bottom portion of the member for frictional engagement with the floor. A lock structure is provided so as to cause fixed engagement between the tubular members.

U.S. Pat. No. 4,358,758, issued on Nov. 9, 1982, and U.S. Pat. No. 4,442,427, issued on Apr. 10, 1984, both to David C. Morton describe a combination door lock and alarm which has an upper end clip engagable with the door handle, a shaft extending in an adjustable length tube and terminating with a non-skid rubber button adapted to frictionally engage the floor. An alarm device is mounted on the shaft and includes an actuator with a switch contact normally abutting a surface of the door at a point below the door handle. The alarm sounds upon inward movement and pressure on the door.

U.S. Pat. No. 4,483,558, issued on Nov. 20, 1984, to V. Van Meter shows a door security device having an elongated rod member of telescoping rod sections, a reversible foot member pivotally connected to the lower end of the rod member, and an abutment member for engaging the surface of the door beneath the door knob. An annular head is pivotally connected to the upper end of the rod member for engaging the shaft of the door knob.

U.S. Pat. No. 4,563,027, issued on Jan. 7, 1986, to Chechovsky et al. provides a door security brace which carries a pivotted foot piece at its lower end having a friction facing to prevent slippage while in contact with the floor. The brace bar carries a pivotted yoke on a pivot axis which is parallel to the foot piece pivot axis. The yoke engages the door knob shank.

U.S. Pat. No. 4,607,253, issued on Aug. 19, 1986, to Wooten et al., provides a combination door lock and alarm having an adjustable shaft, two pivot pads, and an automatic alarm. The pivot feature of the pads is designed for quick set-up of the device. The alarm utilizes a spring clip in contact with a toggle switch. The toggle switch allows for a continuous alarm signal. The alarm is actuated by a spring-loaded shaft which is pushed into the main shaft of the device as pressure is applied to the door. The spring clip is mounted on the outside of the spring-loaded shaft and the movement of this shaft is what forces the clip to trip the toggle switch.

U.S. Pat. No. 4,883,297, issued on Nov. 28, 1989, to D. R. Smith provides a power operated door guard in which an electric motor is utilized so as to cause the parts of the brace to telescope and engage the door knob and the floor.

It is an object of the present invention to provide a door locking device, with shock sensor alarm that is simple to install, easy to manufacture, and relatively inexpensive.

It is another object of the present invention to provide a door locking device which properly distributes bracing forces so as to maximize strength and protection against unauthorized entry.

It is another object of the present invention to provide a door locking device that maximizes surface friction against a floor.

It is still another object of the present invention to provide a door locking device having an alarm which is actuated by vibration.

It is a further object of the present invention to provide a door locking device with a siren-type of alarm.

These and other objects and advantages of the present invention will become apparent from a reading of the attached specification and appended claims.

SUMMARY OF THE INVENTION

The present invention is a door locking device with alarm for portable use and ready installation on a door handle which comprises a shaft portion having an arcuate shape, a non-skid end portion mounted on a lower end of the shaft portion, and a door handle engaging bracket affixed to an end of the shaft portion opposite the end portion. The bracket has a generally U-shaped configuration. The shaft portion receives a threaded member at the lower end thereof. The threaded member is affixed to a foot of the end portion. The threaded member is rotatable so as to move the foot portion relative to the shaft portion.

The bracket has a prong formed on the interior of the U-shaped configuration. This prong extends upwardly from the shaft portion and has a height which is less than the height of the bracket. Both the bracket and the prong are coated with a rubberized material.

The present invention also includes an alarm device which is mounted on the shaft portion. This alarm device is responsive to shocks above a given threshold which affect the door handle or door itself. The alarm produces an audio output in response to shocks above this threshold value.

The alarm device includes a housing suitable for attachment to an exterior surface of the shaft portion, an alarm emitter connected to the housing so as to produce an audio output, and a shock-responsive circuit positioned within the housing and electrically connected to the alarm emitter. The shock-responsive circuit passes a signal to the alarm emitter in response to the shocks above the threshold value. The alarm emitter is a siren. A time-delay circuit is provided so as to limit the length of time for the audio output of the siren. Specifically, the shock-responsive circuit includes a circular conductor opening having a given diameter, and a coil spring extending into the conductor opening. The conductor opening has a greater diameter than the coil spring. The coil spring is movable so as to contact the circular conductor opening in response to shocks above the given threshold value. The coil spring has a longitudinal axis which is concentric with the conductor opening.

The alarm device further includes an on/off switch and a light-emitting diode which are electrically connected to the circuitry within the housing and which are positioned on an exterior surface of the housing.

The shaft portion of the present invention has an arcuate shape extending outwardly from the bracket. A straight section extends downwardly from this arcuate shape. Finally, an angled section extends vertically downwardly from an end of the straight section. The end portion is threadedly received by this angled section.

DETAILED DESCRIPTION OF THE INVENTION

Figure 1:
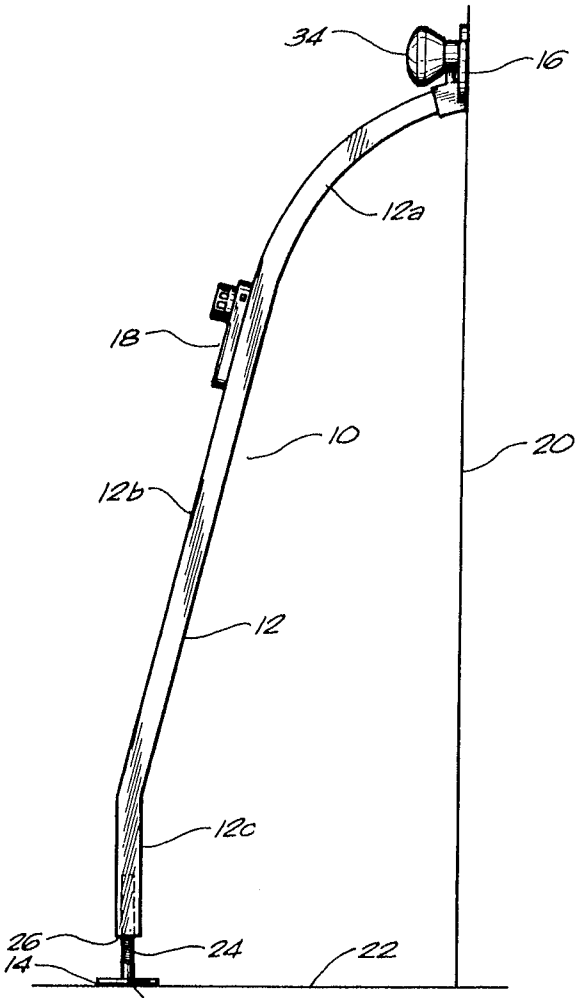
FIG. 1 is a side elevational view of the door locking device in accordance with the preferred embodiment of the present invention.

Referring to FIG. 1, there is shown at 10 the door locking device in accordance with the preferred embodiment of the present invention. Door locking device 10 includes a shaft portion 12, a non-skid end portion 14, a door handle engaging bracket 16, and an alarm device 18. It can be seen that the door locking device 10 is shown as juxtaposed against door surface 20 and floor 22.

The shaft 12 is a specially designed shape having a configuration particularly designed for the purposes of preventing entry through door 20. In particular, the shaft 12 has an arcuate shape 12*a* extending outwardly from the door handle engaging bracket 16. The arcuate shape 12*a* extends outwardly and downwardly to a straight section 12*b*. The straight section 12*b* extends from the end of arcuate shape 12*a* until it reaches an angled portion 12*c*. Angled portion 12*c* extends vertically downwardly from the straight section 12*b*. In experiments with the present invention, it was found that the arcuate shape 12*a*, in combination with the straight section 12*b* and angled section 12*c*, causes a greater amount of pressure to be distributed to the end portion 14 juxtaposed against floor 22. This allows the door locking device 10 to provide greater resistance to the opening of door 20.

As can be seen in FIG. 1, the shaft portion 12 has a threaded member 24 which threadedly engages the shaft 12 at the bottom end 26 of shaft 12. The threaded member 24, in general, telescopically engages the shaft 12. The threaded member 24 is affixed to the foot 27 of end portion 14. In general, the threaded member 24, and the foot 27 are rotatable with respect to the end 26 of shaft 12 so as to move the foot 27 relative to the shaft 12. In this manner, the end portion 14 can telescope relative to the shaft portion 12. When the desired length is achieved for the device 10 of the present invention, then the threaded engagement between threaded member 24 and the internal threads of end 26 of shaft 12 will cause the foot member 27 to be fixed in its proper position.

As can be seen, the bracket 16 has a surface for fitting in flat juxtaposition against the door 20. The bracket 16 also includes a portion which engages the door handle 34. As can be seen, the door handle 34 extends through an opening in the U-shaped configuration of bracket 16. A prong 36 is provided in a suitable position for abutment with the shaft of the door knob 34. By positioning the bracket in juxtaposition to the door, the bracket is prevented from moving upwardly.

It can further be seen that the alarm device 18 is a box which is fastened to the exterior of shaft 12. Shaft 12 is comprised of square steel tubing. The alarm device includes a VELCRO (TM) strip of hook-and-loop material on its bottom surface. Similarly, the shaft 12 will include a complementary section of this VELCRO (TM) material positioned on the straight section 12. In this manner, the alarm device 18 can be removably fastened to the exterior surface of the straight section 12*b* of shaft 12. This serves to fix the alarm device in a proper position. A more detailed description of the alarm device 18 is provided hereinafter.

Figure 2:
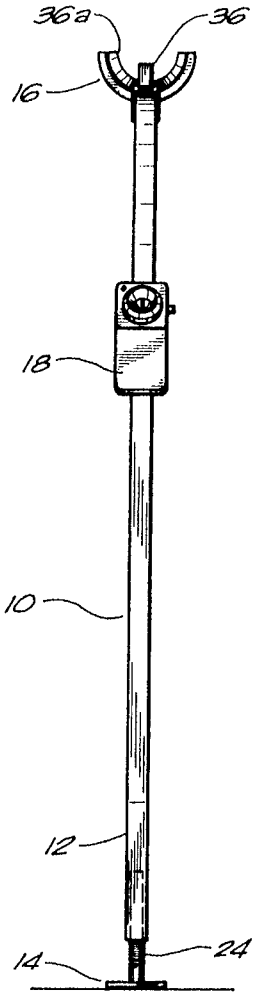
FIG. 2 is an end view of the door locking device of the present invention.

FIG. 2 provides an end view showing the configuration of the door locking device 10. In particular, it can be seen that the shaft 12 telescopically engages the threaded member 24. The configuration of the telescoping threaded member 24 allows the door locking device 10 to be adaptable to a wide ranging array of door sizes, shapes, and configurations. The alarm device 18 is affixed to the exterior of shaft 12 generally near the door engaging bracket 16.

In FIG. 2, it can be seen that the door-engaging bracket 16 has a generally U-shaped configuration. Prong 36 extends upwardly and centrally within this U-shaped configuration. In general, the U-shaped configuration will abut the surface of the door and extend around the door knob frame. In general, the door knob frame is of a circular configuration and is positioned generally beneath the door knob shaft. The prong 36 fits underneath the shaft of the knob. Ideally, the prong will gently touch the bottom of the knob shaft. The U-shaped configuration should touch the door surface after the prong 36 attaches to the knob shaft. This configuration further provides the unexpected benefit of force distribution. As such, the device creates an extra strong force for preventing intrusion through the door. Abutment forces are distributed between the U-shaped configuration and the prong 36. Both the U-shaped configuration 16 and the prong 36 are coated with a rubberized material 36*a*. The rubberized material 36*a* will prevent any marring of the finish of the door knob or the door knob frame. The rubberized material also provides friction against the upward movement of the bracket with respect to the door. This helps to keep the forces on the door rather than the door handle.

Figure 3:
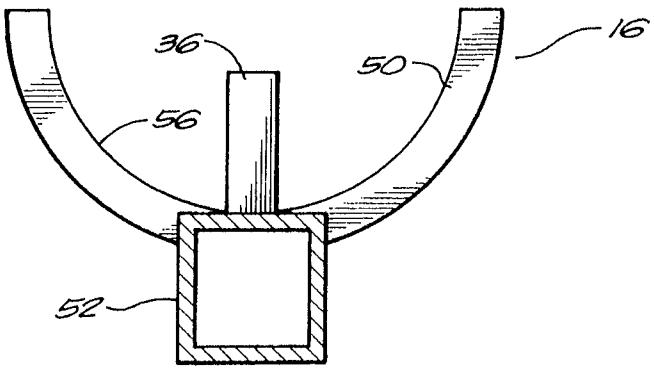
FIG. 3 is an isolated end view showing the door handle engaging bracket of the door locking device of the present invention.

FIG. 3 is an isolated view showing the bracket 16. Initially, it can be seen that the U-shaped head 50 has a generally semi-circular configuration. The head 50 is made of a strong steel material so as to properly engage the door. The head 50 has a suitable thickness for strong abutment against the door to which it is placed. The head 50 is affixed by welding, or other means, to the square steel tubing 52 of the of the shaft 16. The prong 36 generally extends upwardly from the top surface of the shaft 52 and/or from the inner surface 56 of the head 50. It can be seen that the prong 36 extends upwardly from the top surface of the square tubing 52. The prong 36 generally has a height which is equal to or less than the height of the head 50. This was designed so as to be in relative relation to the strength of the door knob frame and the door knob shut. The sizing of this arrangement is important so as to adequately resist any forces created by the opening of a door.

Figure 4:
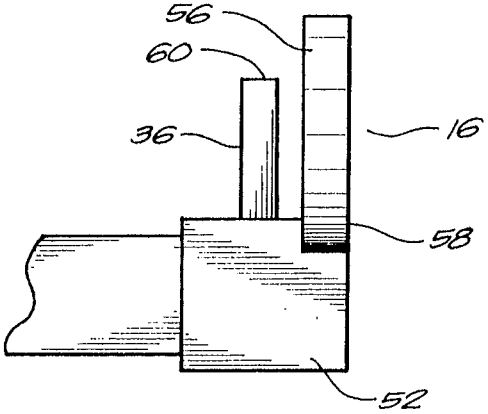
FIG. 4 is an isolated side view of the door handle engaging bracket of the present invention.

FIG. 4 is a side view of the bracket 16 showing that the head 50 is positioned on the far end of the shaft 52. A substantially linear surface 58 is provided between the head 50 and the shaft 52 so as to provide a flat abutment surface for the door. The prong 36 is also attached to the shaft 52 but is positioned behind the location of the head 50. A suitable distance should be provided between the head 50 and the prong 54 so as to accommodate the standard arrangement of door knobs. The top surface 60 of prong 36 will be in general abutment with the door knob shaft.

Figure 5:
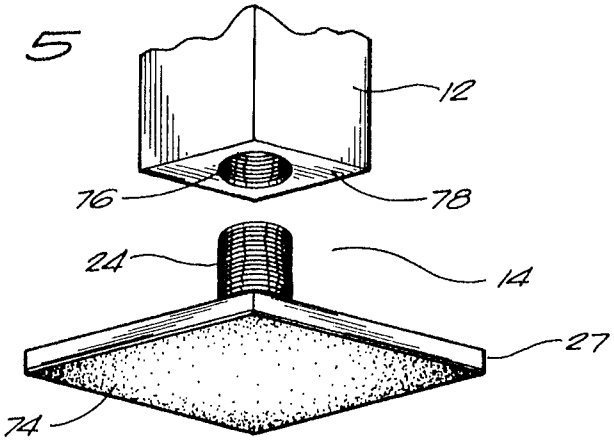
FIG. 5 is an exploded perspective view of the foot and end portion of the present invention.

FIG. 5 is a perspective view of the end portion 14. It can be seen in FIG. 5 that the end portion 14 includes a threaded member 24 which is affixed to a top surface of a foot 72. The bottom surface 74 of foot 27 may be coated with a non-skid material, such as rubber, or other materials. The shaft 12 includes an internal thread 76 which serves to receive the threaded member 24 of end portion 14. By rotating the threaded member 24 within the internal thread 76 of shaft 12, the distance of the foot 27 from the end 78 of shaft 12 can be appropriately adjusted. Since the angled portion 12*c* of shaft 12 extends vertically downwardly, the foot 27 will remain in a generally horizontal floor-engaging position. In use, the adjustable mechanism of the end portion 14 allows the present invention to be adjusted for various sizes of doors.

An important feature of the present invention is the use of the alarm device 18. Prior art alarm devices which have been used with such braces have relied upon a contact with the door or have required that the door actually be opened before the alarm sounds. In general, if the door must actually be opened before the alarm is sounded, then it is too late for the person within a room to properly prepare for the intrusion. It is inherently more desirable that an alarm be provided which is responsive to the early stages of intrusion, rather than the actual intrusion. If the alarm sounds while manipulations are being made to the door knob or door, then an audio alarm may be capable of scaring the would-be intruder from entering the room. Importantly, however, the alarm device should be of a certain sensitivity so as to prevent accidental actuations.

Figure 6:
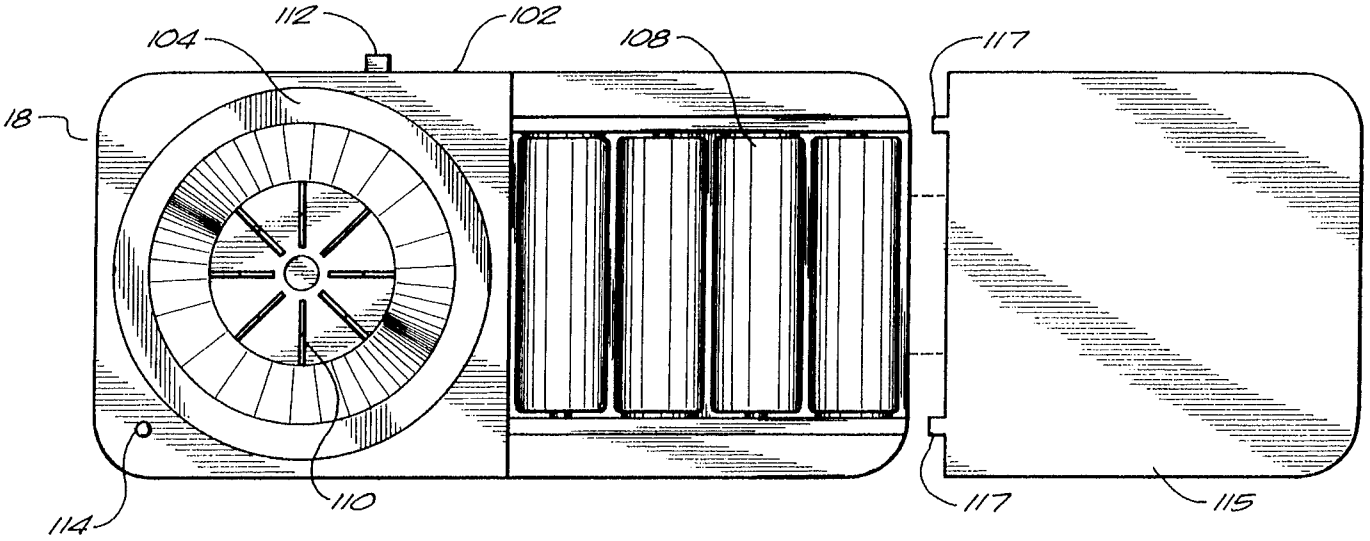
FIG. 6 is a plan view of the alarm device of the present invention.

Referring to FIG. 6, there is shown at 18 the alarm device in accordance with the present invention. The alarm device 18 includes a housing 102, an alarm emitter 104, shock-responsive circuitry 106, and a power source 108. As was described herein previously, the alarm device 18 is removably affixed to an exterior surface of the shaft 12 of the present invention.

The housing 102 is a molded plastic box. So as to provide for additional safety, the corners of the housing 102 are generally rounded.

The alarm emitter 104 is essentially an air-driven siren. Specifically, the siren 104 includes a rotatable member 110 located in the middle of the alarm 104. The rotation of the vanes in the rotatable member 110 causes a sound emission from the alarm emitter 104. Typically, apertures are formed along the walls of the alarm emitter 104 so as to allow for the audio output of the present invention. The rotatable member 110 is driven in response to a shock upon the door knob connected to the shaft 12 of the present invention. The sound produced by alarm 104 is very loud and continuous. As such, the use of the alarm 104 serves as an effective deterrent from the continued intrusion by a person through the door 20.

An on/off switch 112 is provided on housing 102. Switch 112 serves to activate, or deactivate, the alarm device 18 of the present invention. When the switch is in the "off" position, no power will flow from the power source 108 to the alarm 104. When the toggle is in the "on" position, then the circuitry 106 will become responsive to shocks and will allow for the activation of the rotatable member 110 so as to produce an audio output. A light emitting diode 114 is also provided on the surface of enclosure 102 to provide a visual indication of whether the switch 112 is in the on or off position.

The circuitry 106 is provided on the interior of enclosure 102. Circuitry 106 is described in Greater detail in connection with FIG. 8. Essentially, the circuitry 106 is responsive to shocks acting upon enclosure 102 which are above a given threshold value. When a shock above the threshold level is received, the circuitry 106 will serve to transfer power from the power source 108 to the alarm 104 so as to properly activate the siren of the alarm 104.

The power source 108 comprises a plurality of batteries that are contained within the housing 102. The batteries are interconnected so as to supply power for the operation of the siren 104 and the circuitry 106. The electrical lines extend through the interior of housing 102 in a conventional manner.

In FIG. 6, it can be seen that a cover 115 is provided so as to be releasably detached over the area of enclosure 102 above batteries 108. Cover 115 includes snaps 117 which engage suitable receiving members on the enclosure 102. The cover 115 is generally a flat rectangular member which is positioned so as to properly secure the batteries 108 within the housing. A bridge member 119 is provided on the underside of cover 115 (as shown in FIG. 7) for juxtaposing the batteries 108 onto the bottom surface of the enclosure 102.

Figure 7:
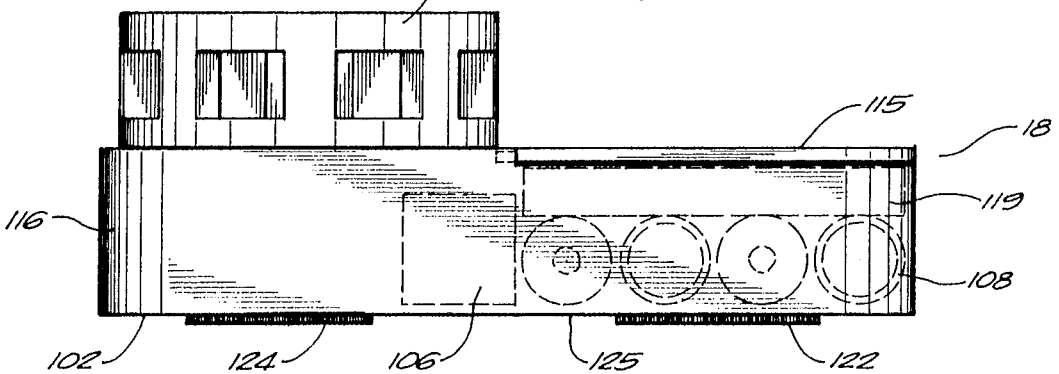
FIG. 7 is a partial cross-sectional side view of the alarm device of the present invention.

FIG. 7 shows a side view of the alarm device 100 of the present invention. It can be seen that the housing 102 is generally a rectangular box which contains the necessary components. The alarm emitter 104 extends outwardly from housing 102. In conventional use, the sound will be emitted from apertures formed through the walls of the alarm 104. The mechanism for the operation of the alarm emitter 104 is contained within area 116 in enclosure 102. The circuitry 106 is contained within compartment 116. A threaded member secures the top and bottom of enclosure 102 together. The power source 108 comprises a plurality of batteries arranged in flat side-by-side configuration within the interior of the housing 102. It can be seen that the switch 102 extends outwardly from the side of the enclosure 102. Importantly, VELCRO (TM) strips 122 and 124 are fastened to the bottom surface 125 of the enclosure 102. This hook-and-loop strips 122 and 124 are suitable for fastening to complementary material on the surface of the shaft 12. As such, the enclosure 102 can be secured into a proper position.

Figure 8:
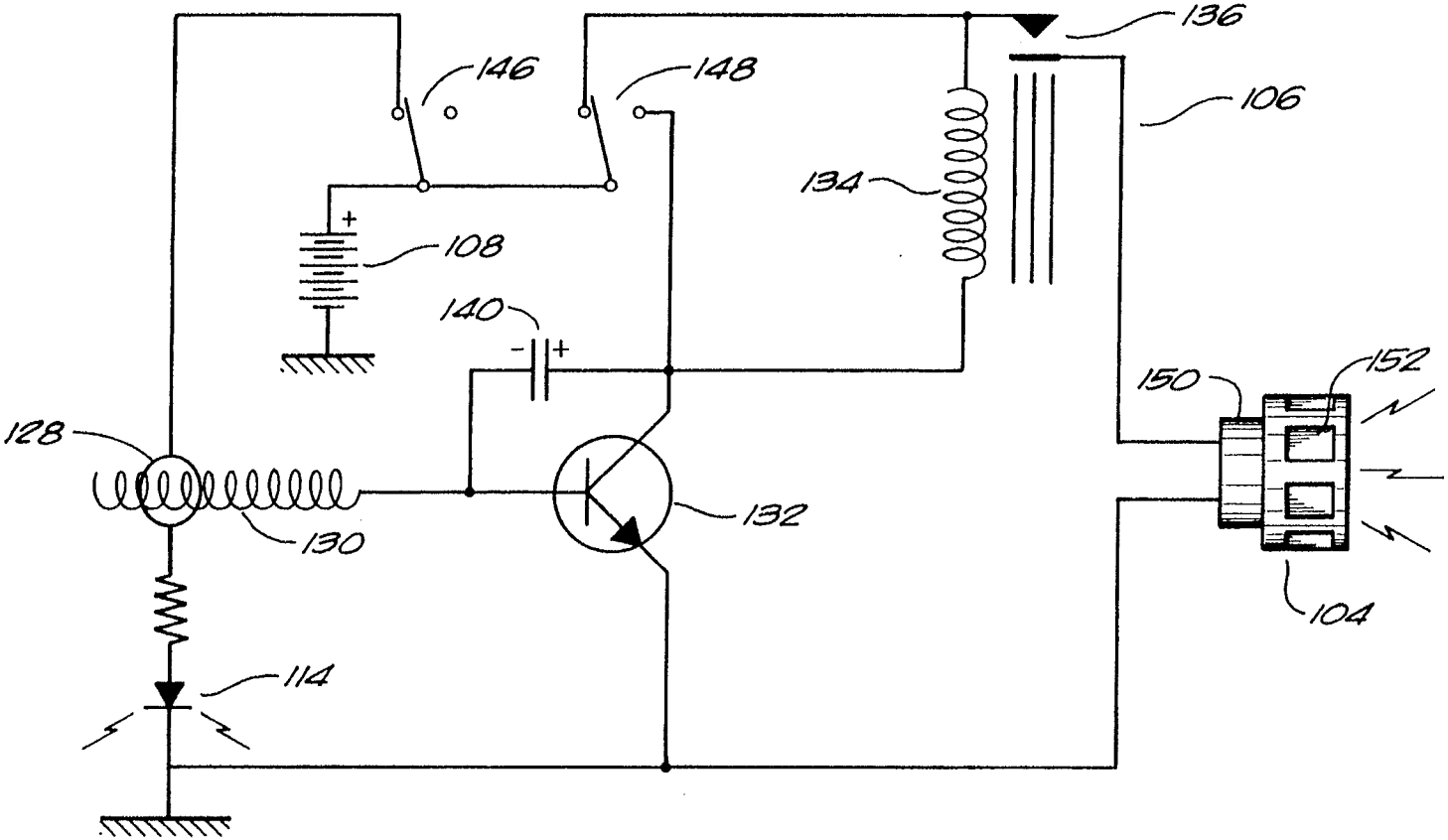
FIG. 8 is an electrical schematic showing the operation of the alarm device of the present invention.

FIG. 8 shows the circuitry 106 which is used in the operation of the present invention. Most importantly, the unique feature of the circuitry 106 is the inclusion of the circular conductor opening 128 and the use of the coil spring 130. The circular conductor opening 128 has a given diameter. The coil spring 130 extends into this opening 128. The coil spring 130 has a smaller diameter than the opening 128. The coil spring 130 is typically flexible and resilient. In the normal use of the enclosure 102, the coil spring 130 will be positioned Generally concentric with the opening 128. However, when a shock is imparted to the enclosure 102, the coil spring 130 will tend to deflect in one direction or another. This will cause the coil spring 130 to come into contact with a surface of the conductor opening 128. In this manner, the present invention acts as a system for activating the alarm when shocks above a Given threshold are received by enclosure 102 by way of shaft 12.

When the enclosure 102 is shaken, the shock sensor spring 130 will create a contact with the conductor opening 128. When a contact is created, this will cause the transistor 132 to turn on. This, in turn, drops the collector voltage to ground level. The relay 134 is then energized. The relay contact points 136 will then turn on the siren 104.

The duration of the siren 104 (in its "on" condition) is determined by the value of the capacitor 140 connected between base and the collector of the transistor 132. Before the base is turned on, the capacitor 140 will be charged to the full capacity when the collector voltage is dropped to ground level. This capacitor 140 starts discharging through the base so as to keep the transistor on until all electricity discharges from the capacitor 140. The transistor will then turn off and the capacitor 140 will be recharged again. The value of the selected capacitor 140 will provide time duration of between six and nine seconds for the siren 104 to stay on. A drop in the voltage from the power supply 108 can also affect the time duration of siren 104.

In FIG. 8, it can be seen that the light emitting diode 114 is illuminated by way of the contacts between the switch 146. When the switch 146 is in the on position, as shown in FIG. 8, power is supplied to the conductor opening 128 which activates the light emitting diode 114. It can also be seen that the switch 146 is also suitable for turning off the siren 138. Since the switch 146 simultaneously activates and deactivates the switch 148, the siren can be turned off by the switch 146. When the switch 146 is turned on, once more, the siren 104 will be in its "off" state.

The power supply 142 transmits power to the rotary motor 150 of siren 138. A rotation of the vanes within the interior of siren 104 causes the emission of sound from the vents 152 located on the side wall of the siren 104.

The present invention offers a large number of benefits over prior art bracing devices. The arcuate shape of the shaft provides for a better distribution of forces between the door knob and the floor. The configuration of the door handle engaging bracket further distributes the forces so as to prevent intrusion. The non-skid foot is ideal for adjusting the device for various heights of door knobs. Additionally, the alarm device is vibration sensitive, rather than intrusion sensitive, so as to provide an immediate alarm to the occupant of a room of the initial stages of door manipulation. The siren of the present invention is very loud. It is believed that this sound will be suitable for discouraging continued intrusion through the door. The present invention is configured in a relatively simple package which is easy to manufacture, simple to use, and relatively inexpensive.

The foregoing disclosure and description of the invention is a illustrative and explanatory thereof. Various changes in the details of the illustrated apparatus construction may be made within the scope of the appended claims without departing from the true spirit of the invention. The present invention should only be limited by the following claims and their legal equivalents.

I claim:

1. A door locking device for portable use and ready installation on a door handle comprising:

a shaft portion;

a non-skid end portion adjustably connected to a lower end of said shaft portion;

a door handle engaging bracket affixed to an end of said shaft portion opposite said end portion, said shaft portion having an arcuate shape extending outwardly from said bracket, said shaft portion comprising:

a straight section extending from said arcuate shape; and an angled section extending vertically downwardly from an end of said straight section opposite said arcuate shape, said end portion received by said angled section; and an alarm device mounted on said shaft portion, said alarm device responsive to shocks affecting the door handle, said alarm device having an audio output.

2. The device of claim 1, said straight section having said alarm device affixed thereto.

3. The device of claim 1, said end portion comprising:

a foot having a generally flat bottom surface; and a threaded member affixed to and extending upwardly from said foot, said threaded member threadedly received by said angled section of said shaft portion.

4. The device of claim 3, said foot and said threaded member rotatable within said angled section so as to adjust a distance of said foot from said shaft portion.

5. The device of claim 3, said foot having a non-skid coating on a surface of said foot opposite said threaded member.

6. The device of claim 1, said shaft portion comprised of square steel tubing.

7. The device of claim 1, said alarm device comprising:

a housing having means thereon for attachment to an exterior surface of said shaft portion;

an alarm emitter connected to said housing so as to produce said audio output; and shock-responsive means positioned within said housing and electrically connected to said alarm emitter, said shock-responsive means for passing a signal to said alarm emitter in response to a shock above a given threshold value affecting the door handle.

8. The device of claim 7, said alarm emitter comprising a siren, said siren having a member rotatable in response to said shock-responsive means, said member for generating a siren output.

9. The device of claim 7, further comprising:

a time-delay circuit electrically connected to said alarm emitter, said time-delay circuit for limiting a length of time for said audio output.

10. The device of claim 7, said shock-responsive means comprising:

a circular conductor opening having a given diameter; and a coil spring extending into said circular conductor opening, said circular conductor opening having a greater diameter than a diameter of said coil spring, said coil spring movable so as to contact said circular conductor opening in response to a shock above said given threshold value.

11. The device of claim 10, said coil spring having a longitudinal axis concentric with said circular conductor opening.

12. The device of claim 7, said alarm device further comprising:

an on/off switch electrically connected to said alarm emitter, said on/off switch positioned on an exterior surface of said housing; and an LED electrically connected to said on/off switch, said LED positioned on an exterior surface of said housing, said LED indicative of a position of said on/off switch.

13. The device of claim 7, said shaft portion having a section of hook-and-loop material fastened to an exterior surface, said alarm device having a complementary section of hook-and-loop material positioned thereon, said sections of hook-and-loop material engagable such that said alarm device is removably fastened to said shaft portion.

14. A door locking device for portable use and ready installation on a door handle comprising:

a shaft portion;

a non-skid end portion adjustably connected to a lower end of said shaft portion;

a door handle engaging bracket affixed to an end of said shaft portion opposite said end portion, said shaft portion having an arcuate shape extending outwardly from said bracket, said bracket having a generally U-shaped configuration, said bracket having a prong formed interior of said U-shaped configuration; and an alarm device mounted on said shaft portion, said alarm device responsive to shocks affecting the door handle, said alarm device having an audio output.

15. The device of claim 14, said prong extending upwardly from said shaft portion, said prong having a height less than a height of said bracket, said bracket and said prong being coated with a rubberized material.

16. A door locking device for portable use and ready installation on a door handle comprising:

a shaft portion;

a non-skid end portion adjustably connected to a lower end of said shaft portion;

a door handle engaging bracket affixed to an end of said shaft portion opposite said end portion, said shaft portion having an arcuate shape extending outwardly from said bracket, said shaft having a straight section extending from said arcuate shape, said shaft having an angled section extending vertically downwardly from an end of said straight section opposite said arcuate shape, said end portion received by said angled section, said end portion comprising:

a foot having a generally flat bottom surface; and a threaded member affixed to and extending upwardly from said foot, said threaded member threadedly received by said angled section, said foot and said threaded member rotatable within said angled section so as to adjust a distance of said foot from said shaft portion; and an alarm device mounted on said shaft portion, said alarm device responsive to shocks affecting the door handle, said alarm device having an audio output, said alarm device comprising:

a housing having means thereon for attachment to an exterior surface of said shaft portion;

an alarm emitter connected to said housing so as to produce said audio output; and shock-responsive means positioned within said housing and electrically connected to said alarm emitter, said shock-responsive means for passing a signal to said alarm emitter in response to shocks above a given threshold value affecting the door handle.

17. The device of claim 16, said shock-responsive means comprising:

a circular conductor opening having a given diameter; and a coil spring extending into said circular conductor opening, said circular conductor opening having a greater diameter than said coil spring, said coil spring movable so as to contact said circular conductor opening in response to shocks above said given threshold value.

18. The device of claim 16, said bracket having a generally U-shaped configuration, said bracket having a prong formed interior of said U-shaped configuration, said prong extending upwardly from said shaft portion, said prong having a height less than a height of said bracket, said bracket and said prong being coated with a rubberized material.

* * * * *